US009731214B2

(12) United States Patent
Lindaman

(10) Patent No.: US 9,731,214 B2
(45) Date of Patent: Aug. 15, 2017

(54) PLAYHOUSE WITH REMOVABLE FASTENING SYSTEM

(71) Applicant: Ben Lindaman, Robbinsdale, MN (US)

(72) Inventor: Ben Lindaman, Robbinsdale, MN (US)

( * ) Notice: Subject to any disclaimer, the term of this patent is extended or adjusted under 35 U.S.C. 154(b) by 229 days.

(21) Appl. No.: 13/802,964

(22) Filed: Mar. 14, 2013

(65) Prior Publication Data

US 2013/0244538 A1 Sep. 19, 2013

Related U.S. Application Data

(60) Provisional application No. 61/610,709, filed on Mar. 14, 2012.

(51) Int. Cl.
*A63H 18/00* (2006.01)
*A63H 33/00* (2006.01)

(52) U.S. Cl.
CPC ..... *A63H 33/008* (2013.01); *Y10T 29/49826* (2015.01)

(58) Field of Classification Search
CPC ..... A63H 33/008
USPC ..... 446/108, 110, 111, 113, 114, 122, 123, 446/476, 478
See application file for complete search history.

(56) References Cited

U.S. PATENT DOCUMENTS 949,412 A * 2/1910 Betz ..... 411/228
1,398,852 A * 11/1921 Gilbert ..... 446/112
2,179,575 A * 11/1939 Hosking ..... 411/162
3,120,078 A * 2/1964 Bessinger ..... 446/112
3,217,773 A * 11/1965 Munse ..... 411/175
3,263,727 A * 8/1966 Herpolsheimer ..... 411/136
3,516,389 A * 6/1970 Meyer ..... 119/417
3,669,170 A * 6/1972 Schuster ..... 411/175
3,693,495 A * 9/1972 Wagner ..... 411/377
3,774,357 A * 11/1973 Moore ..... 52/36.2
3,998,002 A * 12/1976 Nathanson ..... 446/115
4,139,998 A * 2/1979 Jeavons et al. ..... 70/370
4,389,808 A * 6/1983 Podell et al. ..... 446/123
4,523,418 A * 6/1985 McLaughlin ..... 52/284
4,704,058 A * 11/1987 Crunwell ..... 411/134
4,883,397 A * 11/1989 Dubost ..... 411/174
4,903,451 A * 2/1990 Gresswell ..... 52/584.1
4,978,301 A * 12/1990 Dodge ..... 434/96
5,121,710 A * 6/1992 Gonzalez ..... 119/498
5,162,010 A * 11/1992 Krebs ..... 446/112
5,175,913 A * 1/1993 Mackie et al. ..... 24/562
5,184,436 A * 2/1993 Sadler ..... 52/79.1
5,351,453 A * 10/1994 Leslie ..... 52/270
5,490,359 A * 2/1996 Hepler ..... 52/506.06
5,580,294 A * 12/1996 Briant ..... 446/110
5,707,192 A * 1/1998 Vortriede et al. ..... 411/175
5,865,660 A * 2/1999 Smith ..... 446/106
6,067,691 A * 5/2000 Feltman ..... 24/295
(Continued)

*Primary Examiner* — Melba Bumgarner
*Assistant Examiner* — Joseph B Baldori

(57) ABSTRACT

A playhouse composed of a sheet material is provided that utilizes plastic windows, doors, and fasteners to secure various sections together. The fastener engages a clip that is attached to various sections. The fastener is then twisted to secure the windows and doors to the structure as well as securing two sections together. The playhouse is disassembled for easy storage under a bed or in a closet. Additionally, the fasteners, windows, door, and clips can be re-used with additional corrugated structures or kits.

5 Claims, 2 Drawing Sheets

(56) References Cited

U.S. PATENT DOCUMENTS

| | | | | |
|---|---|---|---|---|
| 6,073,404 | A * | 6/2000 | Norfleet | 52/236.3 |
| 6,250,021 | B1 * | 6/2001 | Ferrara, Jr. | 52/71 |
| 6,418,672 | B1 * | 7/2002 | Hampel | 52/79.1 |
| 6,746,297 | B2 * | 6/2004 | Robjent et al. | 446/108 |
| 6,758,167 | B1 * | 7/2004 | Edelinski | 119/498 |
| 7,581,357 | B2 * | 9/2009 | Richardson et al. | 52/79.5 |
| 7,891,151 | B2 * | 2/2011 | Sano | 52/506.05 |
| 8,177,466 | B2 * | 5/2012 | Csik et al. | 411/174 |
| 8,191,327 | B2 * | 6/2012 | Griffiths et al. | 52/506.08 |
| 8,225,572 | B2 * | 7/2012 | Wallace | 52/512 |
| 8,444,357 | B2 * | 5/2013 | Clarke | 411/162 |
| 8,544,216 | B1 * | 10/2013 | Hazlett | 52/79.5 |
| 8,650,807 | B2 * | 2/2014 | McKimmy et al. | 52/79.9 |
| 8,827,763 | B2 * | 9/2014 | DeBlanco et al. | 446/476 |
| 8,887,354 | B1 * | 11/2014 | Weinman | 16/252 |
| 9,016,003 | B2 * | 4/2015 | Thuma et al. | 52/79.9 |
| 2002/0193046 | A1 * | 12/2002 | Zebersky | 446/476 |
| 2004/0086354 | A1 * | 5/2004 | Harris | 411/161 |
| 2011/0237155 | A1 * | 9/2011 | Leung | 446/476 |
| 2012/0028534 | A1 * | 2/2012 | Unger | 446/111 |
| 2012/0171923 | A1 * | 7/2012 | Hadden | A63H 33/006 446/227 |

* cited by examiner

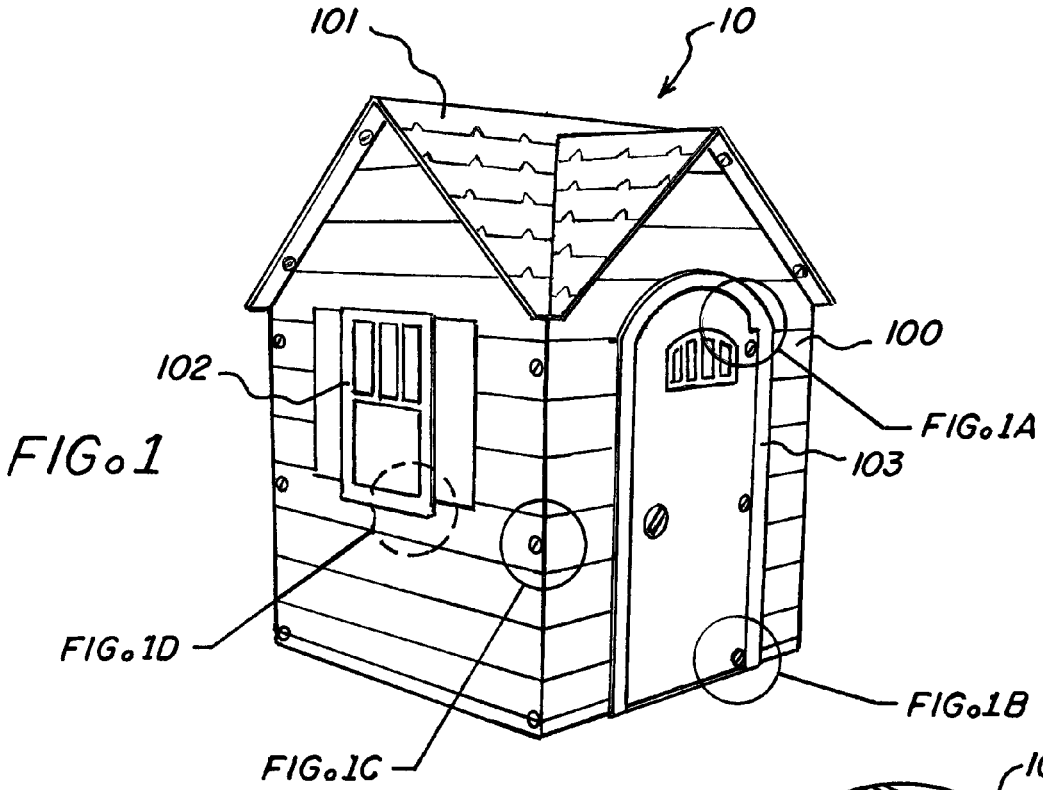
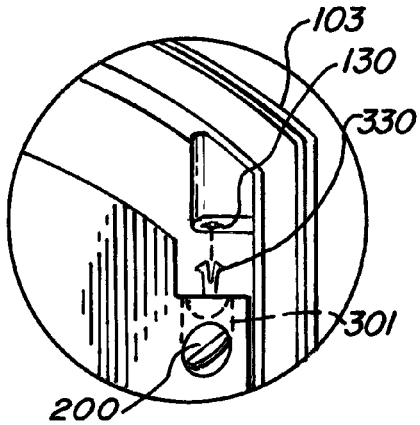
FIG. 1A
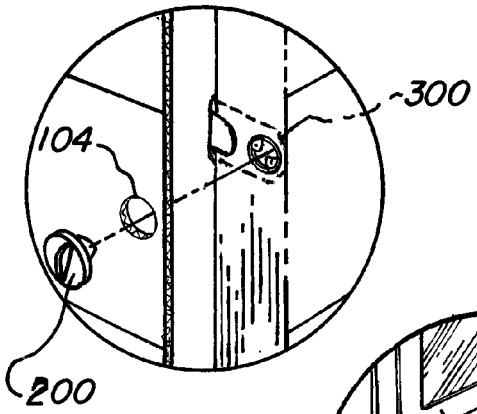
FIG. 1C
FIG. 1D
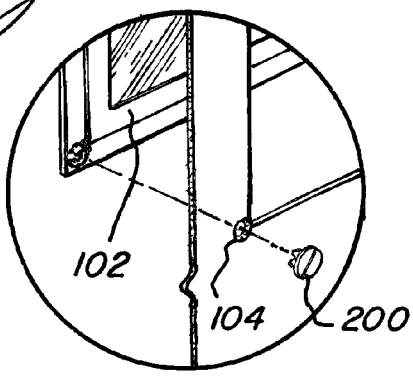
FIG. 1B
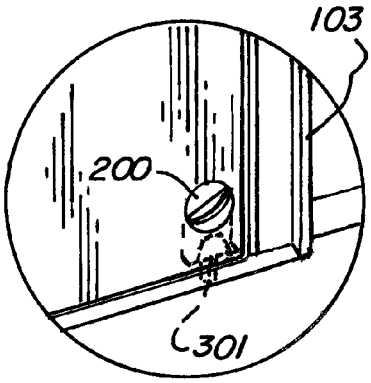

330
302
304
305
303
100
101
300
200
311
301
310
202
203
201
204

PLAYHOUSE WITH REMOVABLE FASTENING SYSTEM

CROSS REFERENCE TO RELATED APPLICATIONS

This application claims the benefit of provisional patent application Ser. No. 61/610,709 filed 2012 Mar. 14 by the present inventor.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to assembled play structures and a system for fastening sheet material together to create playhouses using removable fasteners.

Playhouses have been providing generations of children places to stretch their imagination and escape into a life of pretend make believe. These houses often provide children hours of fun as they explore and pretend to be homeowners, business operators, farmers, or whatever they can imagine. There exist three major types of playhouses: permanent, semi-permanent, and disposable. Permanent playhouse structures are often constructed out of wood similar to a modern house with framing, walls, and include permanent windows, doors, and roofs with shingles. Often these permanent playhouses are constructed onsite and become a permanent structure in the yard of the owner.

The semi-permanent playhouses are typically constructed out of a molded plastic and designed to be assembled by the purchaser. Often these houses are constructed by fitting four walls together and attaching a roof. Typically, the walls and roof are assembled using a slot and tab style assembly or a snap type assembly. Typically, the windows and doors will be pre-cut into the structure. The semi-permanent playhouse is often assembled and left assembled, although it can be disassembled and moved to a new location or stored.

Disposable playhouses are often constructed out of corrugated cardboard with minimal assembly. A Typical cardboard playhouse is constructed out of a preassembled cardboard sheet which is unfolded and secured using pre-cut tabs and slots. The windows and doors are pre-cut. This structure is often easy to assemble and is often recyclable. It does however lack the quality, strength, and finish of a permanent or semi-permanent style playhouse. Therefore, there exists a need to develop a playhouse that has the benefits of a disposable style playhouse with permanence and appearance of a semi-permanent style playhouse. Preferably this playhouse is easy to assemble and disassemble, offers windows and doors with structural integrity, is recyclable, and is easily stored in a closet or under a bed.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein:

FIG. 1 is a prospective view of the playhouse, according to the present invention.

FIG. 1A is a close up view of the upper door hinge of the playhouse as indicated in FIG. 1, according present invention.

FIG. 1B is a close up view of the lower door hinge of the playhouse as indicated in FIG. 1, according present invention.

FIG. 1C is a close up view of the fastening system of the playhouse as indicated in FIG. 1, according present invention.

FIG. 1D is a close up view of the fastening of a window to the playhouse as indicated in FIG. 1, according to the present invention.

DETAILED DESCRIPTION OF THE INVENTION

Figures 2, 3, 4, 5, 6, 7:
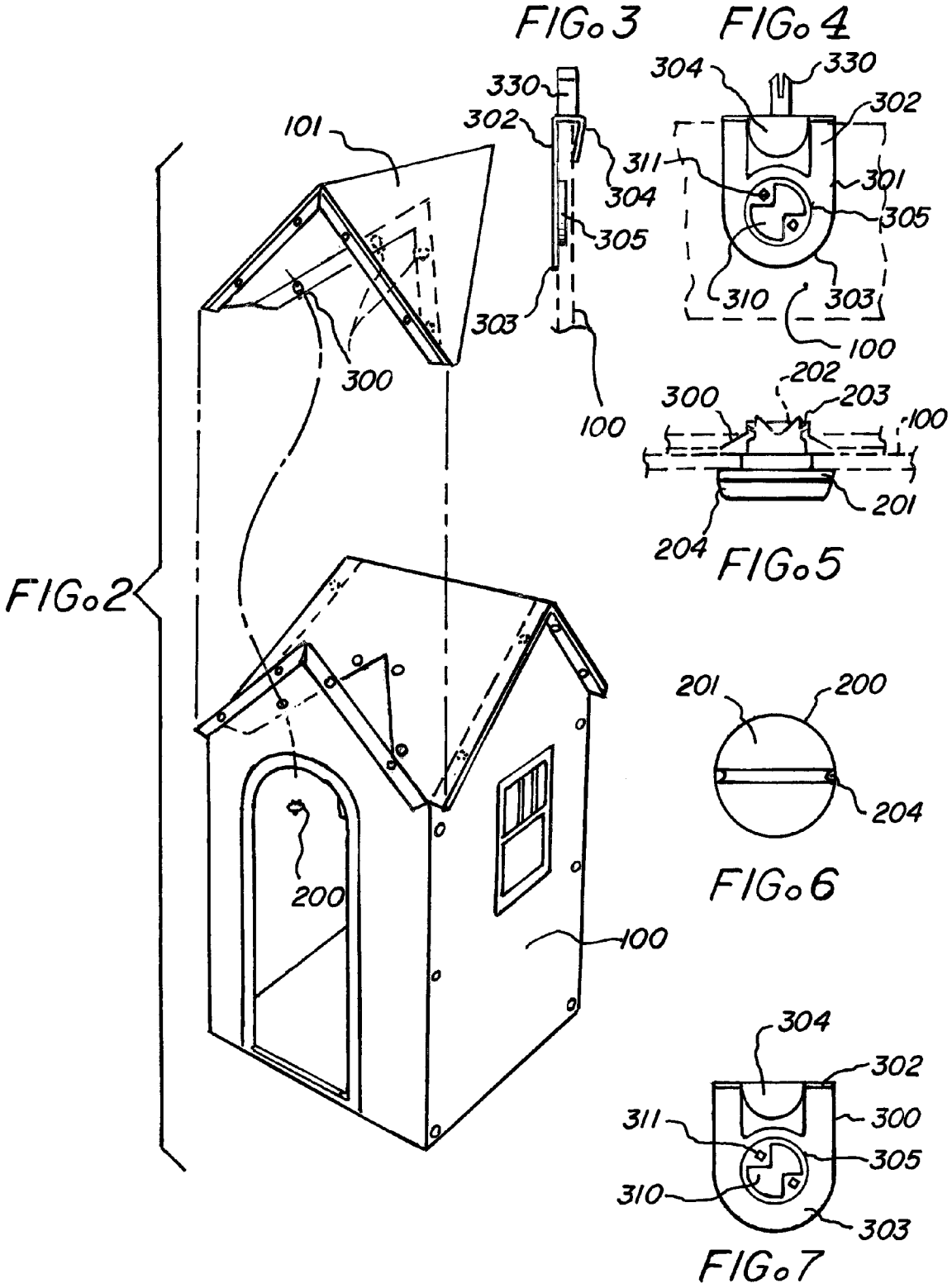
FIG. 2 is an exploded view of the roof attachment of the playhouse, according to the present invention.
FIG. 3 is a side view of the hinge fastening clip, according to the present invention.
FIG. 4 is a front view of the hinge fastening clip, according to the present invention.
FIG. 5 is a side view of the fastener in receipt of the fastening clip, according to the present invention.
FIG. 6 is a top view of the fastener, according to the present invention.
FIG. 7 is a front view of the fastening clip, according to the present invention.

Referring now to FIG. 1 through FIG. 1D, a perspective view of the playhouse assembly with various close-ups there is shown the playhouse generally referred to as 10. The playhouse 10 is a modular structure constructed out of a sheet material with plastic components. This sheet material may be corrugated cardboard, corrugated plastic, foam core, plywood, medium-density fiberboard ("MDF"), or other similar material. In the preferred embodiment, this sheet material is corrugated cardboard laminated with images resembling the interior and exterior of a house. Further, this lamination allows a user to place removable decals on the exterior and the interior of the playhouse 10. The playhouse 10 is received by the user flat in a box and must be assembled. Although the playhouse 10 is depicted in the style of a traditional house, other shapes and designs can be constructed using the disclosed fastening system and method. These styles include but are not limited to, a general store, fire stations, police station, log cabin style home, cottage style home, barn, and other similar designs.

In the preferred embodiment, the playhouse 10 is assembled from four (4) separate wall sections 100, three (3) separate roof sections 101, and one door section (not numbered) folded over to provide added strength and durability. These sections are constructed of sheet material. Of the four separate wall sections 100, two sections are similar. These individual sections 100 and 101 are pre-cut with a fastener aperture 104 designed to receive a fastener 201 and fastener clip 300 or hinged fastener clip 301 or a window frame 102 or a door frame 103 and secured with a fastener 200.

To assemble the playhouse 10, according to the present invention, the user will use the walls 100, fasteners 200, fastener clip 300, hinge fastener clip 301, window 102, and door frame 103 in combination to secure the joints between separate pieces to create a complete structure. The fasteners 200 engage a corresponding fastener clip 300 or hinge fastener clip 301 securing two layers of cardboard together. Additionally, the fasteners 200 secure the framing of the windows 102 and the door 103 to the playhouse structure 10.

Referring now to FIG. 5 and FIG. 6, the fastener 200 is designed to engage the clips 300 and 301. The fastener 200 is generally circular in shape and includes a base 201, handle 204, engagement surface 202, and raised node 203. The engagement surface 202 is hour glass shaped and forms a ramp designed to be received in a primary aperture 310 (FIG. 4, FIG. 7) of the fastening clips 300 and 301 (FIG. 4, FIG. 7). The engagement surface 202 extends outward from the base 201 opposite the handle 204. The preferred depth of the extension of the engagement surface 202 is between nine (9) and eleven (11) millimeters from the bottom of the base 201 opposite the handle 204. This depth is necessary to accommodate the width of two sections of the preferred thickness of the cardboard material used.

The engagement surface 202 further includes a pair of raised nodes 203. These raised nodes 203 are designed to seat in a pair of secondary apertures 311 present on the fastener clip 300 and hinge fastener clip 301 (FIG. 4, FIG. 7). Upon engaging the fastener 200 within the fastener clip 300 and hinge fastener clip 301, the user will rotate the fastener 200 clockwise ninety degrees (90°) wherein the twisting of the engagement surface 202 will tightly secure the fastener 200 to the desired clip 300 or 301. Further, the engagement of the raised nodes 203 into the secondary apertures 311 will make a distinct "clicking" noise, notifying the user that the fastener 201 has been securely engaged.

Referring now to FIG. 3, FIG. 4, and FIG. 7, the various views of the fastener clip 300 and hinge fastener clip 301. The fastener clip 300 and hinge fastener clip 301 are identically shaped with the hinge fastener clip 301 having the addition of a post 330. The post 330 is designed to be received in a hole 130 present on the upper and lower door frame 103 (FIG. 1A, FIG. 1B). The receipt of the post 330 into the hole 130 creates a hinge allowing the door to pivot open and closed.

The clips 300 and 301 have an upper end 302, a lower end 303, a tension arm 304, and a raised portion 305. The raised portion 305 may be cylindrical and sized to correspond to the aperture in the sheet material. The upper end 302 includes the tension arm 304. When viewed in cross section, the tension arm 304 is u-shaped and provides a grasping force to the material as the clips 300 and 301 are attached to the cardboard material. The lower end 303 includes the raised portion 305. When viewed in cross section, the raised portion 305 extends outward from the clips 300 and 301 and parallel to the tension arm 304. The raised portion 305 is sized to be securely received in the aperture 104 present on the various wall, roof, and door structures. The tension arm 304 and raised portion 305 secure the clips 300 and 301 tightly to the substrate and prevent unwanted rotation and ensure proper placement of the clips 300 and 301 during assembly and use.

The raised portion 305 includes the primary aperture 310 and a pair of secondary apertures 311. The primarily aperture 310 is hour-glass shaped to selectively receive the fastener 201 in the proper orientation. The secondary apertures 311 are adjacent to the narrowing of the hour-glass shaped primary aperture 310 and designed to receive the raised node 203 present on the engagement surface 202.

Referring now to FIG. 2, to fasten two materials, such as roof sections 101, a user will affix the appropriate clip 300 or 301 to the desired substrate. The user will then overlap a second substrate over the appropriate clip and insert the fastener 201 by aligning the engagement surface 202 with the aperture primary aperture 310, the user will then rotate the fastener clockwise 90 degrees to secure the connection.

Referring now to FIG. 1D, the windows 102 and door frame 103 contain an identical aperture structure as the fastener clip 300 and hinge fastener clip 301. The window and door frame are constructed out of a molded plastic with a cavity space. This cavity space allows for the inclusion of the primary aperture 310 and the secondary apertures 311. To attach a window 102 or door frame 103 to the playhouse 10, a user will insert the plastic window 102 or door frame 103 into the appropriate space aligning the window 102 or door frame 103 with the appropriate aperture 104 and use the fastener 201 to secure the window 102 or door frame 103 to the appropriate wall section 100.

In the preferred embodiment of the present invention, the playhouse 10 is provided to the user disassembled in a flat style box. This box will be kept by the user for storage of the disassembled structure and be appropriately sized to fit underneath a bed. A user will then place the appropriate fastener clip 300, the hinge fastener clip 301, the window frame 102, and the door frame 103 into the appropriate position on the appropriate wall section 100 or roof section 101, as per the provided instructions. The user will then secure the playhouse structure together using the fastener 201.

In the preferred embodiment of the present invention, the playhouse 10 wall, roof, and door structures are constructed out of a corrugated cardboard. The preferred cardboard is a c-flute corrugate.

In the preferred embodiment of the present invention, the fastener 201, the fastener clip 300, the hinge fastener clip 301, the window 102, and the door frame 103 are constructed out a molded plastic, due to resiliency. Preferably, the plastic used for the window and door frames is polyethylene due to its desirable properties. Preferably, the plastic used for the fastener, fastener clip, and hinge fastener clip is composed of an acrylonitrile-butadiene-styrene ("ABS") based plastic due to its strength and durability. Additionally, it is desired that the fasteners, clips, windows, and door be universally applicable to multiple styles of play structures, wherein a user could order a replacement or add-on kit containing only the corrugated materials and re-use their existing plastic components.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A semi-permanent playhouse structure, the playhouse structure collapsible and assembled, the playhouse structure in combination, comprising:

a sheet material, the sheet material having a thickness and a periphery and provided in pre-cut sections, the sections forming a roof, and a plurality of walls, the sections including pre-cut apertures located along the periphery;

a plurality of clips, the clips sized for receipt on the sheet material and having:

a upper end, the upper end having a tension arm, the tension arm u-shaped and sized to correspond to the thickness of the sheet material, wherein the tension arm provides a grasping force to the thickness of the sheet material; and a lower end, the lower end having a raised portion, the raised portion sized for receipt within the pre-cut apertures at a position flush with the thickness of the sheet material, the raised portion having a primary aperture, the primary aperture having an hour-glass shape, wherein this shape forms a narrow waist region and two wider end regions, a pair of secondary apertures, the secondary apertures each located on opposed sides of the waist region, the secondary apertures each sized to a receive a node, the receipt of the node within each of the secondary apertures providing an audible indicator corresponding to engagement of the node within each of the secondary apertures;

a plurality of fasteners, the fasteners having:

a base;

a handle connected to the base; and an engagement surface, the engagement surface opposite the handle, the engagement surface hour glass shaped for receipt within the primary aperture, the engagement surface forming a ramp to rotationally engage and secure the fastener to the clip, the engagement surface having the raised node, the raised node extending towards the handle, wherein a rotation of the fastener ninety degrees fully engages the fastener within the primary aperture and the nodes within each of the secondary apertures; and a window, the window having a plurality of primary apertures, wherein the window is affixed to one of the sections of the sheet material using the fastener to form a modular structure.

2. The playhouse structure of claim 1, wherein the clip has a post, the post acting as a hinge point for various components.

3. The playhouse structure of claim 1, wherein the structure includes a door.

4. The playhouse structure of claim 1, wherein the sheet material is composed of corrugated cardboard.

5. The playhouse structure of claim 1, wherein the window is composed of plastic.

* * * * *